United States Patent [19]

Gronen et al.

[11] 3,961,887

[45] June 8, 1976

[54] PROCESS FOR THE PRINTING OF CELLULOSE CONTAINING TEXTILE MATERIAL

[75] Inventors: Willy Gronen, Kelkheim, Taunus; Hasso Hertel, Muhlheim, Main, both of Germany

[73] Assignee: Hoechst Aktiengesellschaft, Frankfurt am Main, Germany

[22] Filed: Oct. 9, 1973

[21] Appl. No.: 404,729

[30] Foreign Application Priority Data

Oct. 15, 1973 Germany ..... 2249533
Sept. 15, 1973 Germany ..... 2346612

[52] U.S. Cl. ..... 8/71; 8/2
[51] Int. Cl.[2] ..... C09B 27/00
[58] Field of Search ..... 8/71

[56] References Cited

UNITED STATES PATENTS 2,989,359 6/1961 Kleinen et al. ..... 8/71
3,332,932 7/1967 DeLucia et al. ..... 8/71
3,625,935 12/1971 Back et al. ..... 8/71

*Primary Examiner*—M. J. Welsh
*Attorney, Agent, or Firm*—Curtis, Morris & Safford

[57] ABSTRACT

A process for the printing of cellulose containing textiles or textiles consisting completely of cellulose with water-insoluble azo dyestuffs produced on the fiber, which comprises printing the material previously impregnated with alkaline liquors of β-hydroxynaphthoic acid arylamides or acetoacetic acid arylamides and sodium nitrite with a printing paste containing an aqueous dispersion of an amine suitable for ice color dyeing having a maximum grain size of 0.03 mm or less, acidifiers and a thickening, and finishing the prints after drying in usual manner by washing, soaping and rinsing.

4 Claims, No Drawings

PROCESS FOR THE PRINTING OF CELLULOSE CONTAINING TEXTILE MATERIAL

In "Ratgeber für das Färben von Baumwolle and anderen pflanzlichen Fasern" of I.G. Farbenidustrie dated 1934, a printing process is already described which, in contrast to the usual base printing process, comprises printing of fast color bases with addition of organic acids on textile materials impregnated with β-hydroxynaphthoic acid arymalides and sodium nitrite.

According to this process, the color bases in the form of hydrochlorides or sulfates are first dissolved in water, organic acids are added and the whole is then stirred into the printing thickening. The sodium nitrite necessary for the conversion of these bases to the diazonium compound capable of coupling is previously applied to the textile material by a preliminary impregnation simultaneously with the naphthol preparation. By spontaneous diazotation and coupling on the fiber, the finished (coupling) dyestuff is formed.

The advantage of this method reside in the facts that the complicated diazotation operation can be omitted and that the stability of the printing pastes is unlimited, since they do not contain decomposable diazo compounds. The only disadvantage and main reason for the process not having become important for large-scale manufacture resides in the fact that only such bases can be used the hydrochlorides or sulfates of which are entirely water-soluble. Therefore, it has hitherto not been possible to offer an almost unlimited choice of various colors to the textile printer in his daily practice.

A process has now been found for the printing of cellulose containing textiles or textiles consisting completely of cellulose with water-insoluble azo dyestuffs produced on the fiber, which comprises printing the material previously impregnated with β-hydroxynaphthoic acid arylides or acetoacetic acid acylides to which sodium nitrite has been added with a printing paste containing an aqueous dispersion of an amine suitable for ice color dyeing having a maximum grain size of 0.03 mm or less, acidifiers and a thickening, and finishing the prints after drying in usual manner by washing, soaping and rinsing.

According to this new method, the naphthol/nitrite impregnation process can be carried out using also such bases the hydrochlorides or sulfates of which are scarcely soluble or insoluble in water or hydrolyze, since these bases are employed as dispersions.

It is therefore possible to offer an almost unlimited choice of color shades for this process in the industrial practice, since now also nitranilines for example
- 2-nitraniline (C.I. No. 37025)
- 3-nitraniline (C.I. No. 37030)
- 4-nitro-2-amino-anisol (C.I. No. 37130)
- 5-nitro-2-amino-anisol (C.I. No. 37125)
- 5-nitro-2-amino-toluene (C.I. No. 37100) 5-nitro-4-amino-anisol (C.I. No. 37135)

amino-sulfonic acid amides for example
- 2-amino-anisol-4-sulfonic acid acid diethyl-amide (C.I. No. 37150)

- 2-amino-anisol-4-sulfonic acid n-butyl-amide (C.I. No. 37151)

amino-nitriles for example
- 1-amino-2,5-dimethoxy-4-benzonitrile (C.I. No. 37170)

benzoyl-phenylene-diamines for example
- 1-amino-4-benzoylamino-2,5-dimethoxy-benzene (C.I. No. 37155)
- 1-amino-4-benzoylamino-2,5-diethoxy-benzene(C.I. No. 37175)
- 2-amino-4-methyl-5-benzoylamino-anisol (C.I. No. 37165)

diamino-diphenyls for example
- o-tolidine (C.I. No. 37230)
- dianisidine (C.I. No. 37235)

and other amines used in ice color dyeing may be employed.

The dispersions of suitable amines (base dispersions) required for the new process may be prepared according to different methods.

For example, the dispersion may be obtained by grinding the amine in an aqueous paste, advantageously in the presence of a dispersing agent in order to avoid formation of agglomerations. This operation may be carried out in a rolling or vibration mill charged with balls; especially suitable are ball mills with agitator charged with glass beads or natural sand. Also a pulverization by means of the so-called dissolver often gives satisfactory results.

According to another operation mode, a solid preparation is introduced into water; this preparation being obtained by spray drying of a base dispersion containing a solid dispersing agent, or by grinding of a mixture of a solid dispersing agent and the amine, for example in a disk attrition mill.

Suitable dispersions may also be obtained by introducing a solution of the amine and an appropriate dispersing agent in a water-soluble solvent into water.

The dispersing agents used may be of the cationic, anionic or nonionic kind and, for example, belong to the following classes of substances: alkyl-polyglycol ethers, such as addition products of alkylene-oxide to fatty alcohols, for example stearyl or oleyl alcohol or coconut fatty alcohol; alkylaryl-polyglycol ethers, such as addition products of alkylene-oxide to nonylphenol; aryl-polyglycol ethers; alkyl-amino-oxethylates; trialkyl-aralkyl-ammonium salts, such as trialkyl-benzyl-ammonium chlorides; trialkyl-phosphine-oxides, such as dodecyldimethyl-phosphine-oxide; alkyl-aryl-sulfonates, such as sodium salt of isobutyl-naphthalenesulfonic acid; aryl-sulfonates; lignin-sulfonates; sulfonated cresol/formaldehyde resins; formaldehyde/naphthalenesulfonic acid condensation products; carbacyl-amino-sulfonic acids, such as N-oleyl-N-methyltaurine, and similar substances.

Especially suitable dispersing agents are polyalkyleneglycol ethers of the formula $$R-O-Ar-CH_2-Ar-O-(CH_2-CH_2-O)_n-R$$

where R is an alkyl radical having from 1 to 3 carbon atoms. Ar is an arylene radical, preferably a phenylene radical, and n represents a number of from 7 to about 50.

In order to obtain perfect prints according to the present invention, the maximum grain size should be 0.03 mm or less. The amine should be finely distributed in the dispersions in such a manner that no disturbing deposit of the base particles occurs during storage of the padding liquors, which generally is ensured in the case of a grain size distribution in accordance with the Ramler-Rosin law $$R = 100 \cdot e^{-(d/d')^n}$$

wherein R represents grain size distribution, $d$ is the actual grain diameter, $d'$ is the main grain diameter, $n$ is the "grain parameter," i.e., the slope of the line in this graphical method, and e is the base of natural logarithms and wherein the "mean grain sized" is 0.001 mm or less. The method is discussed in detail in Chemie Ingenieur Technik 36 (1964) 523 et sequ.

The dispersions contain from about 25 to 60% of base and from about 4 to 15% of dispersing agent. They may contain also other agents, such as glycol or glycerol, in order to avoid freezing or dessication; or a fungicide, such as pentachlorophenol, in order to suppress a possible mold formation during prolonged storage.

These base dispersions give printing pastes of practically unlimited stability. An especially interesting criterion of these pastes is their excellent compatibility with reactive dyestuffs, above all with those of the vinylsulfone kind, so that also dyestuff mixtures of base dispersions and reactive dyestuffs may be printed on material being impregnated with naphtholate/nitrite, and thus the coloration range is again extended. Prints of such dyestuff mixtures are only aftertreated according to one of the usual two-phase processes in order to fix the reactive dyestuff component.

The same goes for mixtures of base dispersions and phthalocyanine condensation dyestuffs (ingrain types) soluble in organic acids, so that the choice of colors may be extended to include also vivid green shades.

However, also the base dispersions as prepared according to the process of the invention, even at different coupling power, may be combined to give uniform color shades which may be reproduced at any time. This is a further important and surprising advantage over the hitherto known base and dyeing salt print, where only few or no possibilities at all of preparing combination shades existed.

Diazotation and coupling, in the case of the base dispersions in accordance with the present invention, occur immediately after the printing, although slightly less rapidly than in the case of printing fast dyeing salts or already diazotized fast bases. This slowing down of the coupling gives the components more time for migration and diffusion, so that a substantially better penetration of the prints is obtained. This factor is of special importance for the manufacture of Africa prints.

Suitable acidifiers in accordance with this invention being present in the printing pastes in order to incite formation of the diazonium compound from the amine and the nitrite and thus to ensure coupling with formation of the azo dyestuff, generally are acids of organic nature, for example formic, acetic, glycolic, lactic, gluconic, tartaric, citric acid or mixtures of these acids. On the other hand, also certain inorganic acidic salts, such as monosodium-dihydrogen phosphate, sodium hydrogen sulfate or aluminum sulfate, may be used.

With respect to combination of the base dispersions with reactive dyestuffs, this operation mode depends on two behavior criteria of the reactive dyestuffs. These dyestuffs must be acid-resistant and not be prone to acid hydrolysis on the one hand, and on the other they must be capable of being fixed on the fiber by one of the known two-phase fixing processes. Suitable in this respect are preferably those reactive dyestuffs which form an ether-like bond with the hydroxyl groups of the cellulose, for example the β-hydroxyethylsulfone-sulfuric acid ester and β-hydroxy-ethylsulfone-phosphonic acid ester types, and reactive dyestuffs having one or more N-methyl-N-β-sulfatoethylsulfonamino, β-sulfato-ethyl-aminosulfone, chloropropionyl-amido, β-sulfate-ethyl-carbonamido, phenylpropionylamidosulfone or 2,2,3,3-tetrafluoro-cyclobutane-1-acryloylamino groups. With certain precautions, reducing the sensitivity to acid hydrolysis, for example by addition of sodium acetate to the printing paste, also a series of those reactive dyestuffs may be used for the process of the invention which react like esters with the cellulose, for example those containing a mono or dichloro-triazine, trichloro-pyrimidine, dichloro-quinoxaline, dichloro-phthalazine, dichloro-pyridazine group or similar groups.

Fixing of the reactive dyestuffs may be carried out after the printing of the dyestuff mixture of base dispersion and reactive dyestuff and subsequent drying, according to one of the usual two-phase processes. After padding with an electrolyte containing alkaline solution of specific composition, the printed material is either steamed for 5 to 50 seconds (two-phase steaming process or two-phase rapid steaming process), passed for 4 to 6 seconds through a field of infrared radiation having a radiation energy of 40 KW/m² (two-phase infrared process) or the material wound and cuttled up is maintained in the bath at room temperature for 10 minutes to several hours depending on the reactivity of the dyestuffs employed (two-phase pad-batch process). Most advantageous, however, is the so-called two-phase wet fixing process, wherein the material printed and dried is passed for 5 to 12 seconds through a bath having a temperature of from 95° to 100°C and containing electrolyte and alkali (roller vat. open-width box etc.), and immediately after this operation washed continuously in an open-width washing mashine and/or hank washer.

The following examples illustrate the invention. The Colour Index numbers cited are taken from the 3rd edition, 1971. Quantities and percentages of substances indicated are by weight unless otherwise stated.

EXAMPLE 1

A cotton fabric blended and mercerized is first impregnated with a naphtholate solution prepared as follows:

A mixture of 20 ml of ethanol, 20 ml of sodium hydroxide solution 38° Be (32.5%), 10 ml of sulfonated castor oil, and 30 ml of water having a temperature of 40°C is poured over 20 g of coupling component C.I. No. 37505, which is dissolved with agitation. Subsequently, 30 g of sodium nitrite are added and a total quantity of 1 liter is adjusted by addition of hot water having a temperature of from 80° to 90°C.

After impregnation at a temperature in the vicinity of boiling temperature, the material is dried after having been exposed to air for about 20 seconds. In the meantime, the following printing paste is prepared:

20 g of color base C.I. No. 37235 — dianisidine — as 60% dispersion are diluted with 200 ml of warm water having a temperature of 40°C, and, after addition of 70 ml of 90% lactic acid and 30 ml of 50% acetic acid, the whole is stirred into 400 g of a 8% thickening of an ether of locust bean flour, and a total amount of 1 kg is adjusted by adding water or thickening.

The printing pastes may also contain the usual auxiliaries, such as defoamers, sequestration agents and sodium salt of m-nitrobenzene-sulfonic acid.

On a screen printing machine, any chosen design may be printed with the printing dye so obtained, and, after the known after-treatment, an indigo-blue pattern having the usual fastness properties is obtained with excellent yield.

The base dispersion is prepared as follows: 7060 g of wet dianisidine, having a water content of 15% are thoroughly mixed with 450 g of a polyalkyleneglycol ether of the formula

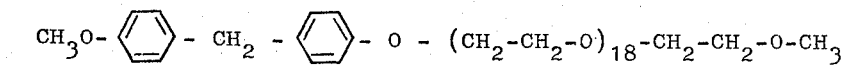

1000 g of ethyleneglycol, 20 g of sodium salt of pentachlorophenol and 1470 g of water. Subsequently, the mixture is ground on a continuously operated ball mill with agitator (capacity of the milling zone: 1 liter) and charged with 1200 g of siliquartzite beads having a size of from 1 to 3 mm, until the required degree of fine distribution is attained after about 15 hours.

EXAMPLE 2

An impregnation liquor is again prepared by pasting 20 g of coupling component C.I. No. 37610 with 20 ml of ethanol, to which paste a mixture of 15 ml of sodium hydroxide solution 38° Be (32.5%), 10 ml of sulfonated castor oil and 40 ml of water having a temperature of 40°C is poured. 30 g of dissolved sodium nitrite are added to this solution, and a total amount of 1 liter is adjusted by adding warm water having a temperature of 60°C.

After impregnation and drying, the fabric is printed on a cylinder printing machine, using the following printing dye; 25 g of color base C.I. No. 37130 as 50% dispersion are diluted with 250 ml of warm water having a temperature of 40°C. after addition of 60 ml of 90% lactic acid and 20 ml of 85% formic acid, stirred into 400 g of a 3% thickening on the basis of hydroxyethyl-cellulose, and adjusted to a total amount of 1 kg by addition of water or thickening.

After printing and the usual after-treatment, a yellow pattern on white bottom having the known fastness properties is obtained with excellent color yield.

EXAMPLE 3

A section of the impregnated cotton material of Example 1 is printed with the following printing paste: 20 g of color base C.I. No. 37175 as 30% dispersion are diluted with 200 ml of water having a temperature of 40°C, after addition of 30 ml of 90% lactic acid and 50 ml of 50% glycolic acid, stirred into 400 g of a 5% thickening on the basis of galactomannan, and adjusted to a total amount of 1 kg by adding water or thickening.

After the usual after-treatment, a blue printing pattern having the known fastness prperties and an excellent penetration is obtained with best color yield.

EXAMPLE 4

A combination dye is prepared using the following dyestuff components: 10 g of color base C.I. No. 37165 as 40% dispersion. 10 g of water-soluble color base C.I. No. 37120 and 10 g of water-soluble color base C.I. No. 37005.

Warm water having a temperature of 40°C is poured over these components, 60 ml of 90% lactic acid and 50 ml or 50% acetic acid are added, the whole is stirred into 400 g of a 3% thickening of hydroxy-ethyl-cellulose, and a total amount of 1 kg is adjusted by adding water or thickening.

Using the printing dye so obtained, a causticized spun rayon fabric impregnated as described in Example 1 is printed on a flat printing machine and finished as usual. A printing pattern having a deep red-brown color on a purely white bottom and completely penetrated is obtained with good color yield.

EXAMPLE 5

A further printing dye is prepared as follows: 20 g of color base C.I. No. 37130 as 50% dispersion is diluted with 200 ml of water having a temperature of 40°C, 60 ml of 90% lactic acid and 20 ml of 50% acetic acid are added, and the whole is stirred into 400 g of a 8% thickening of an ether of locust bean flour. Subsequently, 30 g of a reactive dyestuff being available at phthalocyanine/nickel complex in a commercial form having the following formula

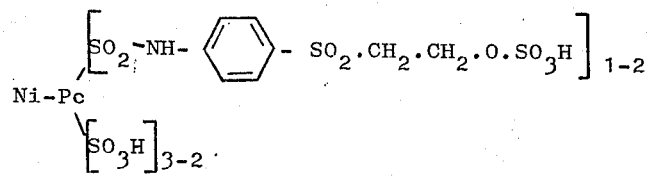

are either strewed into this printing paste or added to it after having been dissolved in 150 ml of hot water, and a total amount of 1 kg is adjusted by adding water or thickening.

The printing dye so obtained may be printed on the textile material impregnated as described in Example 1 or Example 2 in accordance with any printing process whatsoever.

For fixing the reactive dyestuff, the printed material is continuously passed for 6 seconds, according to the wet fixing process, through a fixing liquor having a temperature of 96°C and containing 100 g/l of sodium chloride 150 g/l of sodium carbonate 50 g/l of potassium carbonate and 70 ccm/l of sodium hydroxide solution 38° Be (32.5%) and immediately finished as usual by washing, soaping and rinsing.

In this manner, on the material impregnated according to Example 1, a deep dark-brown pattern is obtained with best yield, while the design on the material impregnated according to Example 2 shows a brilliant yellowish green.

EXAMPLE 6

A part of the cotton fabric impregnated according to Example 2 is printed, using the following printing paste: 18 g of color paste C.I. No. 37125 as 50% dispersion are diluted with 200 ml of warm water having a temperature of 40°C, 60 ml of 90% lactic acid and 30 ml of 50% acetic acid are added, the whole is stirred into 400 g of a 5% thickening on the basis of galactomannan, and a total amount of 1 kg is adjusted by adding water or thickening.

After the usual after-treatment, a golden yellow design according to the pattern having an optimum penetration and the usual fastness properties is obtained with best color yield.

EXAMPLE 7

A further section of the cotton fabric impregnated according to Example 2 is printed with a printing paste of the following composition: 30 g of the phthalocyanine precondensate Ingrain Blue 13, C.I. No. 74160 (Colour Index, Additions and Amendments, Number 20, Page 523) are dissolved in 220 ml of water (20° – 30°C) and 50 ml of 50% acetic acid, and stirred into 400 g of a 8% thickening of an ether of locust bean flour. A further 20 g of color base C.I. No. 37125 as 50% dispersion are added to this printing dye, as well as 60 ml of 90% lactic acid, 20 ml of 50% acetic acid and 100 ml of water, which gives a total amount of 1 kg.

After the printing and drying, in order to completely condense the phthalocyanine/metal complex dyestuff, a wet fixing process (as described in Example 5) is carried out, and the material is then after-treated as usual.

On account of the combination of color base (which, printed alone according to Example 6 yields a golden yellow shade) with the blue phthalocyanine dyestuff, a pattern of a deep olive green shade having the usual fastness properties but a substantially improved penetration is obtained on the cotton fabric impregnated according to Example 2.

EXAMPLE 8

A bleached and mercerized cotton fabric is padded on a foulard, using a hot impregnation bath prepared as follows:

A mixture of 20 parts of ethanol, 10 parts of 38% sodium hydroxide solution and 30 parts of water having a temperature of 40°C is poured over 20 parts of 2-hydroxynaphthalene-3-carboxylic acid-phenylamide (C.I. No. 37505), which is dissolved with agitation. This stock solution is introduced into a hot solution of 10 parts of 38% sodium hydroxide solution, 10 parts of a protein degradation product/fatty acid condensate and 30 parts of sodium nitrite in 900 parts of hot water.

The liquor uptake is 800 g per kg of dry material.

After a short-time exposition to air, the material is dried and subsequently printed on a cylinder printing machine, using a printing paste prepared as follows:

20 parts of a 50% aqueous dispersion of 4-nitro-2-aminoanisol (containing 7% of a sulfonated cresol/formaldehyde resin as dispersing agent) are stirred with 200 parts of water and, after addition of 30 parts of tartaric acid and 40 parts of lactic acid, stirred into 400 parts of a usual hydroxy-ethylcellulose thickening, and adjusted to a total amount of 1000 parts of paste by adding water or thickening.

After the usual after-treatment of the textile material so printed, a scarlet pattern having the known fastnesses is obtained with a very good color yield.

Results identical with this Example are obtained when instead of the cited formulation one of the following printing pastes is used: 20 parts of an aqueous dispersion of 4-nitro-2-amino-anisol (containing 7% of a condensation product of 1 mole of nonylphenol and 10 moles of ethylene oxide as dispersing agent) are stirred with 200 parts of water, and, after addition of 40 parts of 85% formic acid and 20 parts of monosodium phosphate, stirred into 400 parts of the usual hydroxyethylcellulose thickening, and subsequently a total amount of 1000 parts of paste is adjusted by adding water or thickening.

20 parts of a 50% aqueous dispersion of 4-nitro-2-aminoanisol (containing 7% of a condensation product of 1 mole of a mixture (about 1:1) of stearyl and oleyl alcohol and 8 moles of ethylene oxide as dispersing agent) are stirred with 200 parts of water and, after addition of 40 parts of 85% formic acid and 25 parts of acetic acid, stirred into 400 parts of a usual hydroxyethyl-cellulose thickening, and subsequently a total amount of 1000 parts of paste is adjusted by adding water or thickening.

The dispersions are prepared by grinding in a ball mill with agitator charged with aliquartzite beads.

EXAMPLE 9

A cotton fabric impregnated as described in Example 8 is printed on a screen printing machine with a printing paste prepared as follows:

20 parts of a 45% aqueous dispersion of 3-nitroaniline (containing 10% of a lignin-sulfonate as dispersing agent) are stirred with 200 parts of water and, after addition of 30 parts of tartaric acid and 25 parts of acetic acid, stirred into 400 parts of a thickening of an ether of locust bean flour, and a total amount of 1000 parts of paste is adjusted by adding water or thickening. The material so printed is then dried and subsequently rinsed, washed and dried as usual. A printing pattern of a full, clear orange shade having the usual fastnesses is obtained.

When 30 parts of a 40% aqueous dispersion of 2-amino-1-methoxybenzene-4-sulfonic acid-n-butylamide are used as diazotizable amine, a full, clear pattern of red shade is obtained.

EXAMPLE 10

A cotton fabric impregnated according to Example 8 is printed with a printing paste obtained as follows:

20 parts of an aqueous dispersion of 4-nitro-2-aminotoluene (obtained by mixing 45 parts of dry ground 4-nitro-2-aminotoluene, 7 parts of nonylphenol-undecyglycol ether, 15 parts of ethyleneglycol, 3 parts of n-butanol and 30 parts of water in a dissolver) are stirred with 200 parts of water and, after addition of 40 parts of lactic acid and 40 parts of 85% formic acid, stirred into 400 parts of a usual hydroxy-ethylcellulose thickening, and the whole is adjusted to a total amount of 1000 parts of paste by adding water or thickening.

The printed material is then dried and subsequently rinsed, washed and dried as usual. A scarlet printing pattern having the known fastnesses is obtained.

EXAMPLE 11

A cotton fabric impregnated as indicated in Example 8 is printed with a printing paste prepared as follows: 20 parts of a dyestuff preparation, obtained by dry grinding a blend of equal parts of 5 nitro-2-amino-anisol and a formaldehyde/naphthalenesulfonic acid condensate in a cross-beater mill, are stirred with about 50 parts of hot water. After dilution of the batch with 150 parts of cold water, 40 parts of lactic acid and 40 parts of 85% formic acid are added, and 400 parts of a usual hydroxy-ethyl-cellulose thickening are stirred in. Subsequently, the preparation is adjusted to a total amount of 1000 parts of paste by adding water or thickening.

After the known after-treatment of the material so printed, a blue-red printing pattern having the usual fastnesses is obtained.

EXAMPLE 12

A bleached cotton fabric is padded on a foulard (liquor uptake 800 g per kg of dry material) with a hot impregnation bath prepared as follows:

20 parts of 4,4'-bis(acetoacetylamino)-3,3'-dimethyldiphenyl are introduced into a bath having a temperature of 95°C and containing 1000 parts of water, 20 parts of 38% sodium hydroxide solution, 30 parts of sodium nitrite and 10 parts of a protein degradation product/fatty acid condensate, and dissolved by a short-time boiling.

After short-time exposition to air, the material so impregnated is dried and subsequently printed with a printing paste obtained as follows: 20 parts of a 40% aqueous dispersion of 5-nitro-2-aminotoluene (containing 7% of a sulfonated cresol/formaldehyde resin as dispersing agent) are stirred with 200 parts of water and after addition of 40 parts of lactic acid and 40 parts of formic acid, stirred into 400 parts of a usual hydroxy-ethylcellulose thickening, and a total amount of 1000 parts of paste is adjusted by adding water or thickening.

After the known after-treatment of the textile material, a golden yellow pattern having the usual fastnesses is obtained with good yield.

EXAMPLE 13

A cotton fabric impregnated according to Example 8 is printed with a printing paste obtained as follows: 30 parts of a solution of 1 part of 4'-amino-2,3'-dimethylazobenzene in 1 part each of methylglycol and a castor oil/ethylene oxide condensate are introduced into a mixture of 50 parts of 85% formic acid and 500 parts of water. This dispersion is stirred with 400 parts of a usual hydroxy-ethyl-cellulose thickening, and a total amount of 1000 parts of paste is subsequently adjusted by adding water.

After drying, rinsing, washing and drying the material so printed, a full bordo pattern is obtained.

What is claimed is:

1. A process for the printing of cellulose containing textile or textiles consisting completely of cellulose with water-insoluble azo dyestuffs produced on the fiber, which comprises: printing the material previously impregnated with alkaline liquors of (1) $\beta$-hydroxy-naphthoic acid arylamides and sodium nitrite or (2) acetoacetic acid arylamides and sodium nitrite, with a printing paste containing an aqueous dispersion of an amine suitable for ice color dyeing having a maximum grain size of 0.03 mm or less, acidifiers and a thickening, and finishing the prints after drying in usual manner by washing, soaping and rinsing.

2. A process as claimed in claim 1 wherein the amine dispersion contains alkyl-polyglycol ethers, alkylaryl-polyglycol ethers, aryl-polyglycol ethers, alkylamineoxethylates, trialkyl-aralkyl-ammonium salts, trialkylphosphine oxides, alkylaryl-sulfonates, aryl-sulfonates, lignin-sulfonates, sulfonated cresol/formaldehyde resins, formaldehyde/naphthalenesulfonic acid condensation products or carbacyl-aminosulfonic acids as dispersing agents.

3. A process as claimed in claim 2, wherein the amine dispersion contains a polyalkyleneglycol ether of the formula $$R—O—Ar—CH_2—Ar—O—(CH_2—CH_2—O)_n—R$$

where R is an alkyl radical having from 1 to 3 carbon atoms. Ar is an arylene radical, preferably a phenylene radical, and n represents a number of from 7 to about 50.

4. A process as claimed in claim 1 wherein the amine dispersion contains additionally reactive dyestuffs or phthalocyanine dyestuffs and which comprises also so called twophase fixing process for the finishing of such dyeings in the case of using reactive dyestuffs.

* * * * *